US011774108B2

(12) United States Patent
Park et al.

(10) Patent No.: US 11,774,108 B2
(45) Date of Patent: Oct. 3, 2023

(54) COOKING APPARATUS, METHOD OF CONTROLLING THE COOKING APPARATUS, AND KNOB OF COOKING APPARATUS

(71) Applicant: Samsung Electronics Co., Ltd., Suwon-si (KR)

(72) Inventors: Chang Hyun Park, Suwon-si (KR); Hwa-Sung Kim, Suwon-si (KR); Su-Ho Jo, Suwon-si (KR); Jae Hoon Cha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 135 days.

(21) Appl. No.: 15/733,286

(22) PCT Filed: Dec. 19, 2018

(86) PCT No.: PCT/KR2018/016268
§ 371 (c)(1),
(2) Date: Jun. 19, 2020

(87) PCT Pub. No.: WO2019/124986
PCT Pub. Date: Jun. 27, 2019

(65) Prior Publication Data

US 2021/0095859 A1 Apr. 1, 2021

(30) Foreign Application Priority Data

Dec. 21, 2017 (KR) ..... 10-2017-0176667

(51) Int. Cl.
*F24C 7/08* (2006.01)
*F24C 3/12* (2006.01)

(52) U.S. Cl.
CPC ..... *F24C 7/085* (2013.01); *F24C 3/126* (2013.01)

(58) Field of Classification Search
CPC ..... A47J 37/1228; A47J 37/1295; A47J 37/1214; A23L 5/11; A23L 7/13;
(Continued)

(56) References Cited

U.S. PATENT DOCUMENTS 5,464,955 A * 11/1995 Cole ..... D06F 34/32 200/312
7,462,795 B2 12/2008 Montalvo
(Continued)

FOREIGN PATENT DOCUMENTS

DE 102006001251 A1 7/2007
EP 2650422 A1 10/2013
(Continued)

OTHER PUBLICATIONS

Chen, Y., Au, J., Kazlas, P. et al. Flexible active-matrix electronic ink display. Nature 423, 136 (2003). <https://doi.org/10.1038/423136a> (Year: 2003).*
(Continued)

*Primary Examiner* — Dana Ross
*Assistant Examiner* — Bryan M Badalamenti

(57) ABSTRACT

The present disclosure relates to a cooking apparatus, a method of controlling the cooking apparatus, and a knob of the cooking apparatus. An aspect of the present disclosure is to provide a display on a knob for setting a function of a cooking apparatus and to display status information of the cooking apparatus through the display of the knob, so that a user can easily and conveniently check the status information of the cooking apparatus. The cooking apparatus includes a knob comprising a fixing member fixed to a main body of the cooking apparatus, a rotating member supported by the fixing member and rotatably installed on the main body, and a display provided on the fixing member to display status information of the cooking apparatus; and a
(Continued)

controller configured to transmit the status information of the cooking apparatus displayed on the display through a wireless communication network.

17 Claims, 7 Drawing Sheets

(58) Field of Classification Search
CPC .... A21C 3/00; A21C 3/02; A21C 3/22; Y10T 83/2185; Y10T 83/2196; F24C 3/126; F24C 7/085
See application file for complete search history.

(56) References Cited

U.S. PATENT DOCUMENTS

| | | | | |
|---|---|---|---|---|
| 11,340,648 | B2 * | 5/2022 | Ha | G05G 1/12 |
| 2003/0154970 | A1 | 8/2003 | Huang | |
| 2009/0080176 | A1 | 3/2009 | Claprood | |
| 2013/0092032 | A1 | 4/2013 | Cafferty et al. | |
| 2014/0208958 | A1 | 7/2014 | Porraro | |
| 2015/0153048 | A1 | 6/2015 | Moro et al. | |

FOREIGN PATENT DOCUMENTS

| | | | |
|---|---|---|---|
| KR | 10-2008-0017649 | A | 2/2008 |
| KR | 10-2017-0078301 | A | 7/2017 |
| WO | 2004034371 | A1 | 4/2004 |
| WO | 2017143224 | A1 | 8/2017 |

OTHER PUBLICATIONS

Nick Summers, Sep. 3, 2014, The Next Web, <https://thenextweb.com/news/sony-smartband-talk> (Year: 2014).*

European Patent Office, "Supplementary European Search Report" dated Mar. 22, 2021, in connection with European Patent Application No. 18891500.3, 15 pages.

Supplementary Partial European Search Report dated Dec. 17, 2020 in connection with European Application No. 18891500.3, 17 pages.

International Search Report and Written Opinion of the International Searching Authority in connection with International Application No. PCT/KR2018/016268 dated Apr. 19, 2019, 13 pages.

Notice of Preliminary Rejection dated Apr. 29, 2022, in connection with Korean Application No. 10-2017-0176667, 15 pages.

* cited by examiner

COOKING APPARATUS, METHOD OF CONTROLLING THE COOKING APPARATUS, AND KNOB OF COOKING APPARATUS

CROSS-REFERENCE TO RELATED APPLICATIONS

This application is a 371 National Stage of International Application No. PCT/KR2018/016268, filed Dec. 19, 2018, which claims priority to Korean Patent Application No. 10-2017-0176667, filed Dec. 21, 2017, the disclosures of which are herein incorporated by reference in their entirety.

BACKGROUND

1. Field

The present disclosure relates to a cooking apparatus, and more particularly, to a knob for setting a function of the cooking apparatus.

2. Description of Related Art

A cooking apparatus, such as a gas cooktop or gas oven, includes a heat source that generates heat by burning gas in a main body. In order to supply gas to the heat source, a gas supply pipe is connected. In addition, a valve must be provided in the gas supply pipe to adjust a gas supply amount. The valve rotates within a predetermined angular range through a valve rotation axis, and the amount of gas supplied to the heat source is adjusted by rotation of the valve. The amount of gas supplied to the heat source determines a heating power of the heat source. The valve rotation shaft provided inside the main body of the cooking apparatus is interlocked with a knob provided outside the main body. Therefore, a user can ignite the heat source and adjust the heating power by operating the knob from the outside of the main body of the cooking apparatus.

SUMMARY

An aspect of the present disclosure is to provide a display on a knob for setting a function of a cooking apparatus and to display status information of the cooking apparatus through the display of the knob, so that a user can easily and conveniently check the status information of the cooking apparatus.

An aspect of the disclosure provides a cooking apparatus including: a knob comprising a fixing member fixed to a main body of the cooking apparatus, a rotating member supported by the fixing member and rotatably installed on the main body, and a display provided on the fixing member to display status information of the cooking apparatus; and a controller configured to transmit the status information of the cooking apparatus displayed on the display through a wireless communication network.

The status information of the cooking apparatus displayed on the display may include at least one of cooking time information and cooking heating power information.

The cooking time information may include information of a time counted through a timer.

When a cooking time is set through a user interface for setting the time, a timer based on the set cooking time may be configured to be displayed through the display.

The display may be configured to form a curved surface.

A curvature of the display may be configured to coincide with a curvature of a fixing member.

The display may be made of electronic paper.

The status information of the cooking apparatus displayed through the display may be at least one of numbers and text.

The status information of the cooking apparatus may be configured to be displayed on the display in at least one of numbers, text, icons, and animation.

The controller may be configured to transmit the status information of the cooking apparatus displayed on the display to a mobile device at a remote location.

At least one communication method among Bluetooth and Wi-Fi may be used to transmit the status information of the cooking apparatus to the mobile device.

Another aspect of the disclosure provides a method of controlling a cooking apparatus, the cooking apparatus including a knob comprising a fixing member fixed to a main body of the cooking apparatus, a rotating member supported by the fixing member and rotatably installed on the main body, and a display provided on the fixing member to display status information of the cooking apparatus, the method including: receiving a user setting; starting a count reflecting the user setting in response to an operation of the knob when the operation of the knob occurs; displaying the status information of the cooking apparatus according to the user setting on the display; initializing the count when the count reflecting the user setting ends; and displaying an off state of the knob on the display when the knob is turned off before the count reflecting the user setting ends.

The method may further include initializing the count and then ending the operation of the cooking apparatus corresponding to the knob.

The method may further include displaying the off state of the knob on the display, then initializing the count and ending the operation of the cooking apparatus corresponding to the knob.

Another aspect of the disclosure provides a cooking apparatus including: a plurality of heat sources configured to generate heat by burning fuel; and a plurality of knobs provided to correspond to each of the plurality of heat sources. Each of the plurality of knobs may include a fixing member fixed to a main body of the cooking apparatus, a rotating member supported by the fixing member and rotatably installed on the main body, and a display provided on the fixing member. Status information of the plurality of heat sources corresponding to each of the plurality of knobs may be configured to be displayed for each display of the corresponding knob.

Another aspect of the disclosure provides a knob of a cooking apparatus including: a fixing member fixed to a main body of the cooking apparatus; a rotating member supported by the fixing member and rotatably installed on the main body; and a display provided on the fixing member to display status information of the cooking apparatus.

The status information of the cooking apparatus displayed on the display may include at least one of cooking time information and cooking heating power information.

The cooking time information may include information of a time counted through a timer.

When a cooking time is set through a user interface for setting the time, a timer based on the set cooking time may be configured to be displayed through the display.

The display may be configured to form a curved surface.

A curvature of the display may be configured to coincide with a curvature of the fixing member.

The display may be made of electronic paper.

The status information of the cooking apparatus displayed through the display may be at least one of numbers and text.

The status information of the cooking apparatus may be configured to be displayed on the display in at least one of numbers, text, icons, and animation.

Another aspect of the disclosure provides a home appliance including: a knob comprising a fixing member fixed to a main body of the home appliance, a rotating member supported by the fixing member and rotatably installed on the main body, and a display provided on the fixing member to display status information of the home appliance; and a controller configured to transmit the status information of the home appliance displayed on the display through a wireless communication network.

The home appliance may include at least one of a refrigerator, a washing machine, an air conditioner, a vacuum cleaner, a robot cleaner, a humidifier, and a dryer.

According to an aspect of an embodiment, a display is provided on a knob for setting a function of a cooking apparatus, and status information of the cooking apparatus is displayed through the display of the knob, so that a user can easily and conveniently check the status information of the cooking apparatus.

DETAILED DESCRIPTION

Figure 1:
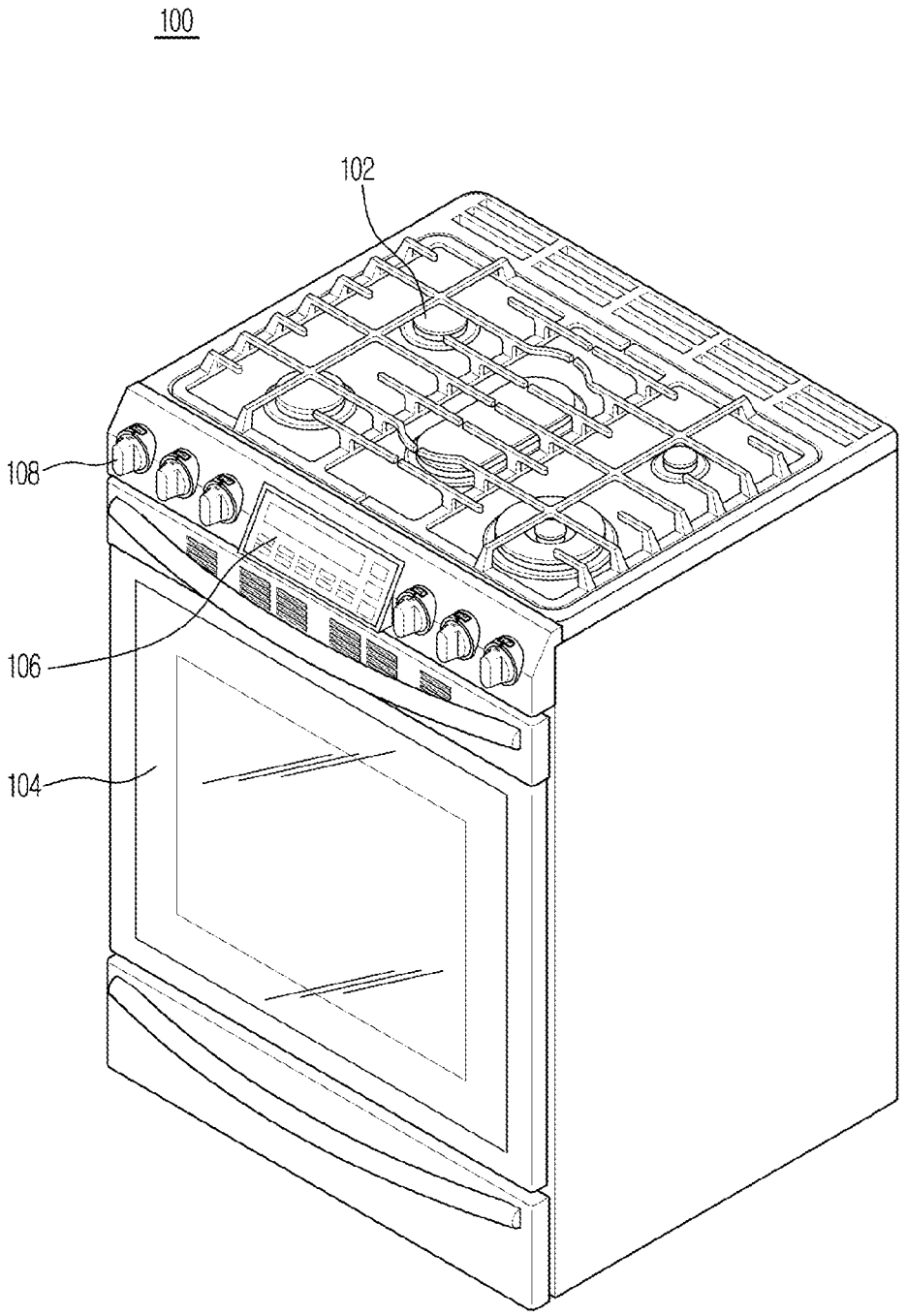
FIG. 1 is a view illustrating a cooking apparatus according to an embodiment.

FIG. 1 is a view illustrating a cooking apparatus according to an embodiment. A cooking apparatus 100 illustrated in FIG. 1 may be a type in which a gas cooktop 102 and an oven 104, which are a plurality of heat sources, are combined.

A plurality of the gas cooktops 102 may be provided on the upper surface of a main body of the cooking apparatus 100. Each of the plurality of gas cooktops 102 may include the plurality of heat sources that burn gas to generate heating power. An electric cooktop using electricity as an energy source may be provided in place of the gas cooktop 102.

In the cooking apparatus 100, the oven (cooking chamber) 104 may be provided below the gas cooktop 102. A plurality of racks may be provided inside the oven 104, and a tray may be mounted to each of the plurality of racks. The tray holds food to be cooked.

A user interface 106 may be provided on the front of the cooking apparatus 100. The user interface 106 may display operation status information of the cooking apparatus 100. In addition, the user interface 106 may be provided to input setting values necessary for cooking.

A knob 108 may be provided for setting a function of the gas cooktop 102 or the oven 104. For example, a user may operate the knob 108 to set functions such as turning on/off the gas cooktop 102 or the oven 104, setting a temperature, and setting a time. The knob 108 may be provided to correspond to the number of the plurality of heat sources provided in each of the gas cooktop 102 and the oven 104. Accordingly, the user may perform independent setting functions for each of the plurality of heat sources using a plurality of the knobs 108.

Figure 2:
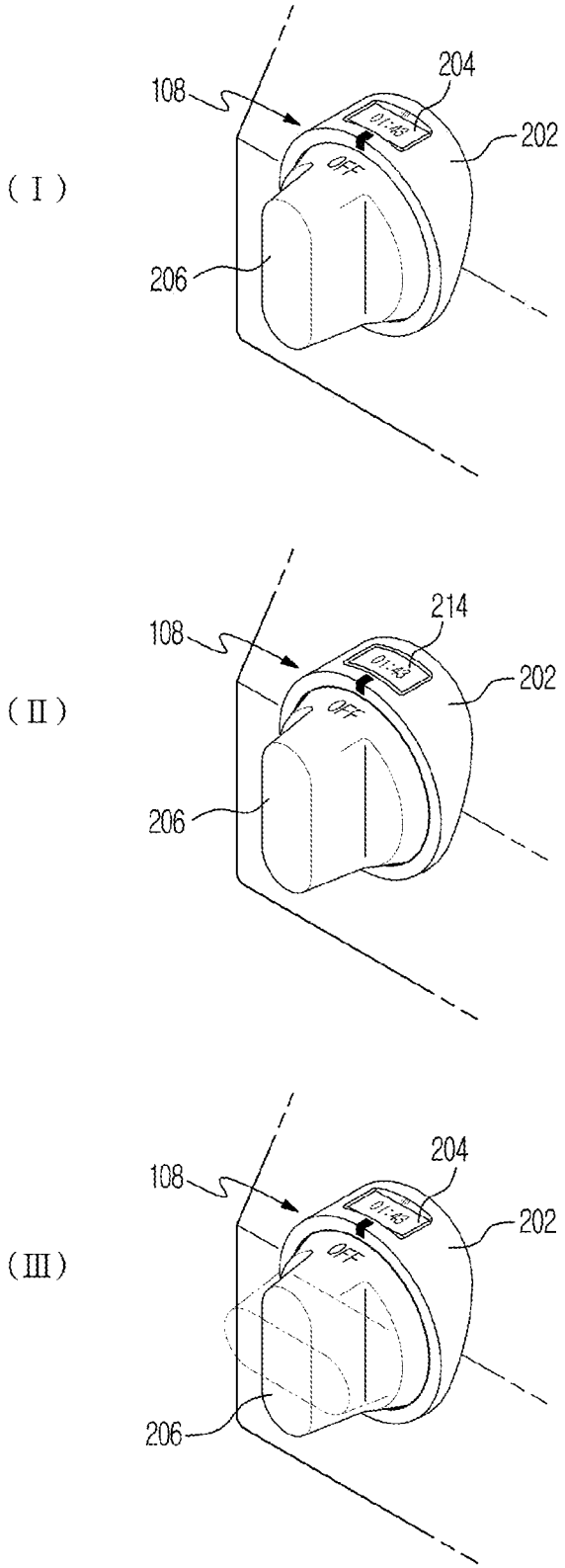
FIG. 2 is a view illustrating a structure of a knob of a cooking apparatus according to an embodiment.

FIG. 2 is a view illustrating a structure of a knob of a cooking apparatus according to an embodiment. The knob 108 may include a fixing member 202, a display 204, and a rotating member 206.

The fixing member 202 of the knob 108 may be fixed to the main body of the cooking apparatus 100. The display 204 is installed on the upper surface of the fixing member 202. The rotating member 206 may be supported by the fixing member 202 and installed to be rotatable on the main body of the cooking apparatus 100. The structures of the fixing member 202, the display 204, and the rotating member 206 will be described in more detail in the description of FIG. 3 described later.

FIG. 2I is a case where the display 204 is a flat panel. That is, the display 204 illustrated in FIG. 2I may have a flat plate structure irrespective of a curved surface formed by a surface of the fixing member 202. Since the flat panel is relatively cheaper than a flexible panel described later, it provides an advantage of implementing the display 204 at a lower cost.

FIG. 2II is a case where a display 214 is the flexible panel. A curved panel of the display 214 illustrated in FIG. 2II may have a curvature equal to or similar to the curvature formed by the curved surface of the fixing member 202. When the curved panel is applied, since it can be configured to have the curved surface equal to the curvature of the fixing member 202, it can be designed to fit well with each other by reducing the heterogeneity between the fixing member 202 and the display 214.

The display 204 may be implemented as a monochrome liquid crystal display (LCD) or a color liquid crystal display (LCD). In addition, the display 204 may be implemented by a thin film transistor liquid crystal display (TFLCD) or an organic light emitting diode (OLED). In addition, the display 204 may be implemented as a passive matrix organic light emitting diode (PMOLED). Also, the display 214 may be implemented with electronic paper or electronic ink (e.g., E-Ink).

FIG. 2III is a view illustrating an operation (movement) of the rotating member 206 in the knob 108. As illustrated in FIG. 2III, the rotating member 206 may be involved in setting the function of the gas cooktop 102 or the oven 104 while rotating a predetermined angle in a clockwise or counterclockwise direction by the user's operation to set the function of the heat source. The function settings may include turning on the heat source and adjusting the heating power. When an 'OFF' mark of the rotating member 206 in FIG. 2III is located at 12 o'clock, the gas cooktop 102 or the oven 104 may be turned off.

When the cooking apparatus 100 includes the plurality of heat sources, the same number of the knobs 108 as the heat source may be provided in the cooking apparatus 100. For example, when the cooking apparatus 100 according to the embodiment includes four of the gas cooktops 102 and one of the ovens 104, five knobs corresponding to five heat sources may be provided. The cooking apparatus 100 according to the embodiment may be provided with the display 214 for every one of the knobs 108. The status information of the gas cooktop 102 or the oven 104 corresponding to each of the knobs 108 may be independently displayed on the display 214 provided for each of the knobs 108. Due to the display of independent status information of each of the plurality of knobs 108, the user may individually check and manage cooking conditions of each of the plurality of heat sources (the gas cooktop 102 or the oven 104).

The application of the knob 108 illustrated in FIG. 2 is not limited to the cooking apparatus 100, and may be applied to other home appliances, including at least one of a refrigerator, a washing machine, an air conditioner, a vacuum cleaner, a robot cleaner, a humidifier, and a dryer.

Figure 3:
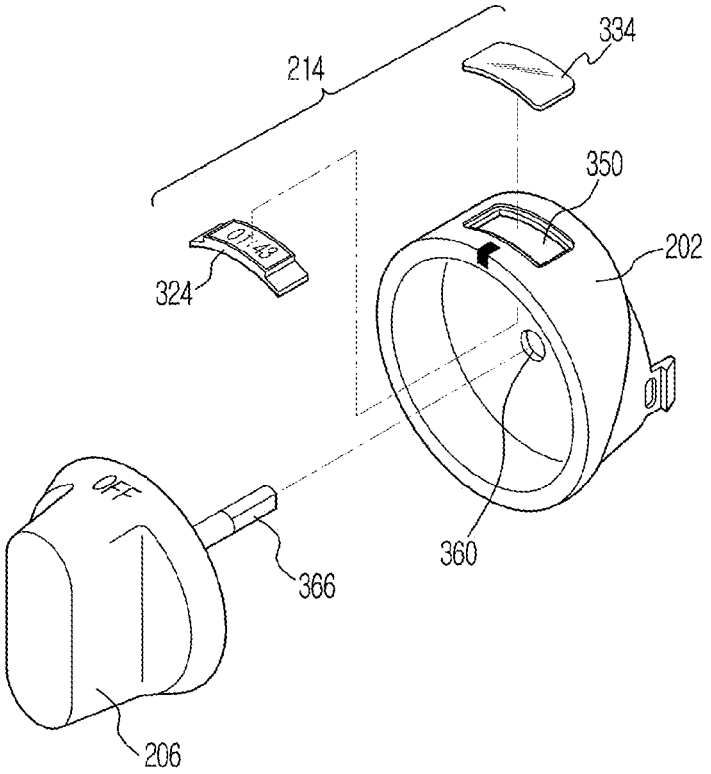
FIG. 3 is a view illustrating a structure of a knob of a cooking apparatus according to an embodiment.

FIG. 3 is a view illustrating a structure of a knob of a cooking apparatus according to an embodiment. The structure of the knob 108 illustrated in FIG. 3 is an example of the display 214 to which the flexible panel illustrated in FIG. 2II described above is applied. The structure of the knob 108 of FIG. 3 may be equally applied to the display 204 to which the flat panel is applied.

A rectangular display mounting hole 350 may be formed on the fixing member 202. A shape and size of the display mounting hole 350 may be determined according to a shape and size of a flexible panel module 324. The flexible panel module 324 of the display 214 may be inserted and fixed in the display mounting hole 350 from the bottom to the top of the display mounting hole 350. In an upper portion of the display mounting hole 350, a transparent material protecting member 334 may be inserted and fixed to protect the flexible panel module 324 from impact and contamination. The protecting member 334 may be tempered glass. That is, the flexible panel module 324 and the protecting member 334 may be inserted and fixed at the top and bottom of the display mounting hole 350, respectively, so that the display 214 and the fixing member 202 are integrated.

A rotating member fastening hole 360 may be provided in a central portion of the fixing member 202. The rotating member 206 may have a rotating shaft 366 for the rotating member 206 to rotate. The rotating shaft 366 of the rotating member 206 may be inserted into the rotating member fastening hole 360 of the fixing member 202 and be mechanically fastened to a structure (for example, a valve rotating shaft provided in a gas pipe) located behind the fixing member 202. When the user rotates the rotating member 206, the rotating member 206 may rotate counterclockwise or clockwise about the rotating shaft 366. The function setting of the gas cooktop 102 or the oven 104 may be achieved by the rotation of the rotating member 206. The function settings may include turning on and off the heat source and adjusting the heating power.

Figure 4:
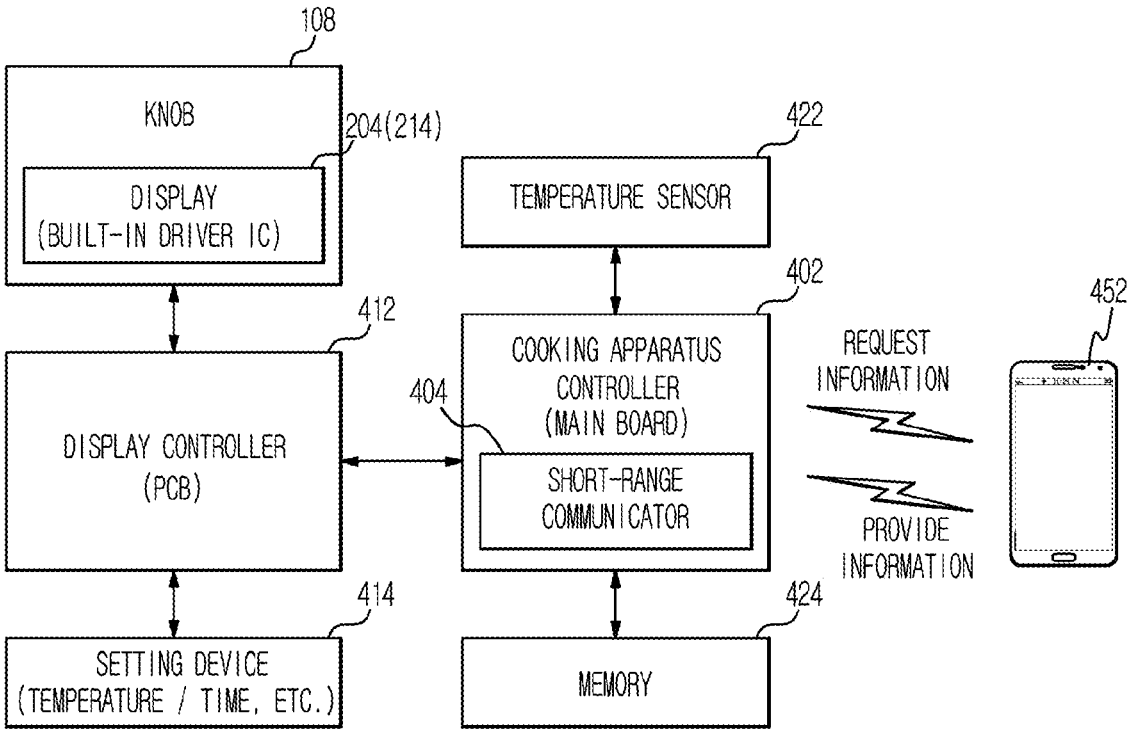
FIG. 4 is a view illustrating a control system of a cooking apparatus according to an embodiment.

FIG. 4 is a view illustrating a control system of a cooking apparatus according to an embodiment. Referring to FIG. 4, the cooking apparatus 100 may be a structure in which a cooking apparatus controller 402 and a display controller 412 are connected to communicate with each other.

The cooking apparatus controller 402 may be provided on a main board, and may be involved in the overall operation of the cooking apparatus 100. That is, the cooking apparatus controller 402 may be involved in the overall control operations of the gas cooktop 102, the oven 104, the user interface 106, and the knob 108 of the cooking apparatus 100.

The cooking apparatus controller 402 may communicate with a mobile device 452 at a remote location through a short-range communicator 404. The cooking apparatus controller 402 may transmit the status information of the cooking apparatus 100 to the mobile device 452 in response to a request from the mobile device 452.

The short-range communicator 404 may be at least one of wireless communication methods such as Wi-Fi, Bluetooth, and Near Field Communication (NFC).

Based on the communication between the cooking apparatus 100 and the mobile device 452, the user may check a state of the cooking apparatus 100 through the mobile device 452. For example, when the user requests the status information from the cooking apparatus 100 using an application (app) for the cooking apparatus installed on the mobile device 452, the cooking apparatus controller 402 of the cooking apparatus 100 may transmit information about a current state of the cooking apparatus 100 to the mobile device 452 through the short-range communicator 404 in response to the request from the mobile device 452.

In addition, the user may perform the function settings such as turning on and off of the gas cooktop 102 and the oven 104 of the cooking apparatus 100 and adjusting the heating power at the remote location using the app installed on the mobile device 452.

The cooking apparatus controller 402 may be communicatively connected to a temperature sensor 422. The temperature sensor 422 may measure a current temperature of the gas cooktop 102 and the oven 104, and provide the temperature measurement result to the cooking apparatus controller 402.

The cooking apparatus controller 402 may be communicatively connected to a memory 424. The cooking apparatus controller 402 may store information related to the cooking apparatus 100 in the memory 424. The information related to the cooking apparatus 100 stored in the memory 424 may include the status information of the cooking apparatus 100. In particular, the information related to the cooking apparatus 100 stored in the memory 424 may include information having the same content as that displayed through the displays 204 and 214 of the knob 108.

The display controller 412 may be provided in a form of a printed circuit board (PCB). The display controller 412 may be involved in a control of the displays 204 and 214. The displays 204 and 214 of the knob 108 may be built-in driver ICs.

The display controller 412 may be communicatively connected to a setting device 414. The setting device 414 may be provided to allow the user to input various setting values necessary for using the cooking apparatus 100. For example, the user may set a desired target temperature and target time through the setting device 414. The setting device 414 may be a separate switch provided on the knob 108 so that the user sets the target temperature and target time. Alternatively, the setting device 414 may be part of the user interface 106 of the cooking apparatus 100 illustrated in FIG. 1.

Figure 5:
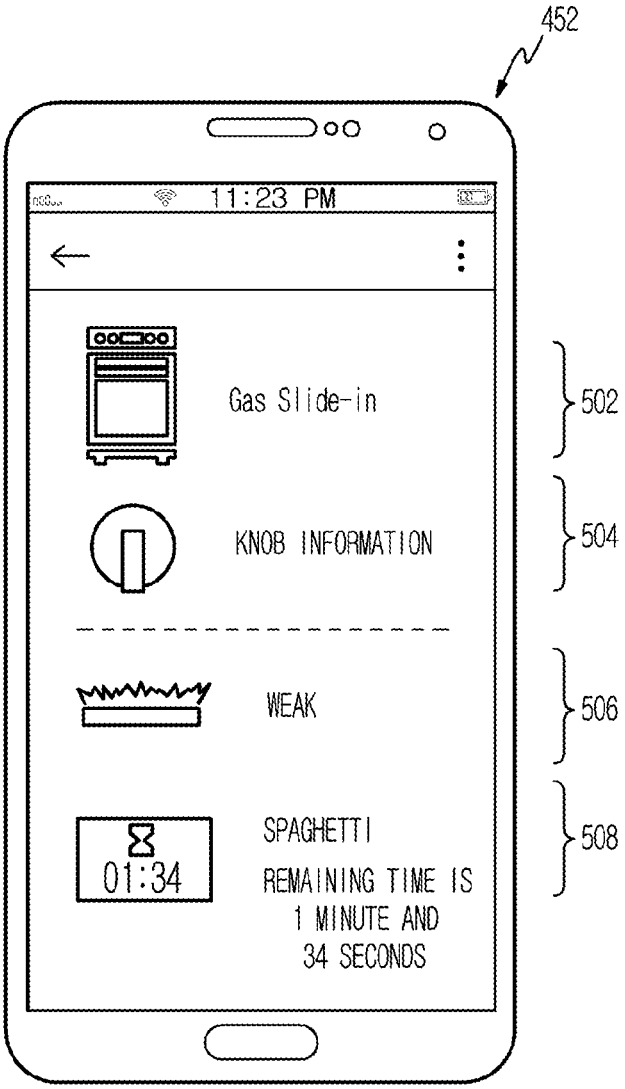
FIG. 5 is a view illustrating that status information of a cooking apparatus is displayed on a mobile device according to an embodiment.

FIG. 5 is a view illustrating that status information of a cooking apparatus is displayed on a mobile device according to an embodiment.

Reference numeral 502 denotes a model name of the cooking apparatus 100. That is, it indicates that the currently selected cooking apparatus 100 is a 'Gas Slide-In' model.

Reference numeral 504 denotes 'Knob information' of the currently selected knob 108. When the plurality of knobs 108 are included like the cooking apparatus 100 of FIG. 1 described above, it can be seen from the 'Knob information' of the reference numeral 504 of FIG. 5 that the knob 108 corresponding to the current heat source is selected.

Reference numeral 506 denotes information of a setting heating power. A 'weak' mark currently illustrated in FIG. 5 indicates that the setting heating power of the heat source corresponding to the knob 108 indicated by the 'Knob information' of the reference numeral 504 corresponds to 'weak' among 'strong/medium/weak.'

Reference numeral 508 denotes information of an automatic cooking menu. The cooking apparatus 100 according to the embodiment may provide various types of pre-programmed automatic cooking menus. For example, the reference numeral 508 in FIG. 5 may be an automatic cooking menu for boiling spaghetti noodles, and a remaining time is 1 minute and 34 seconds. The user can easily and comfortably set an appropriate time and temperature (heating power) to boil the spaghetti noodles by simply selecting the automatic cooking menu for boiling the spaghetti noodles.

Figure 6:
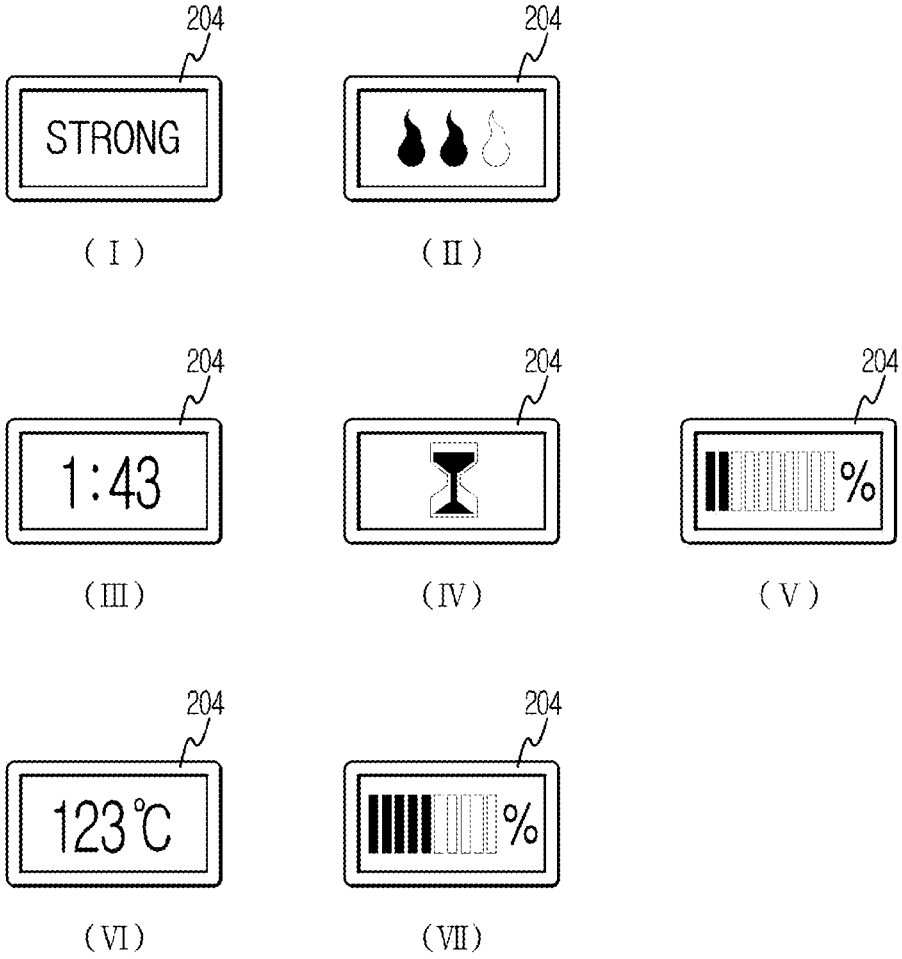
FIG. 6 is a view illustrating various display modes of a display provided on a knob of a cooking apparatus according to an embodiment.

FIG. 6 is a view illustrating various display modes of a display provided on a knob of a cooking apparatus according to an embodiment. In the case of FIG. 6, the display 204 to which the flat panel is applied is exemplified, but the same display mode as that illustrated in FIG. 6 may be applied to the display 214 to which the flexible panel is applied.

FIG. 6I is an aspect of displaying information of the current setting heating power through the display 204 as 'text.' The display 204 illustrated in FIG. 6I may display the current setting heating power of the gas cooktop 102 or the oven 104 corresponding to the corresponding knob 108 through the text 'strong.'

FIG. 6II is an aspect of displaying information of the current setting heating power through the display 204 as an 'icon.' The display 204 illustrated in FIG. 6II may display the current setting heating power of the gas cooktop 102 or the oven 104 corresponding to the corresponding knob 108 through the number of icons. The icon illustrated in FIG. 6II indicates that the heating power of 'medium' among 'strong/medium/weak' is displayed by displaying two flame shapes of three flame shapes in different colors.

FIG. 6III is an aspect of displaying current time-related information as a "number" through the display 204. The display 204 illustrated in FIG. 6III may display the current remaining time of the gas cooktop 102 or the oven 104 corresponding to the corresponding knob 108 through the number '1:43.' That is, FIG. 6III indicates that the time remaining until cooking is completed is 1 minute 43 seconds.

FIG. 6IV is an aspect of displaying current time-related information as an 'animation (sand clock)' through the display 204. The display 204 illustrated in FIG. 6IV may display the current remaining time of the gas cooktop 102 or the oven 104 corresponding to the corresponding knob 108 through the animation in a 'sand clock' shape. That is, FIG. 6IV indicates that the time remaining until cooking is completed is approximately half or more of the entire initial setting time.

FIG. 6V is an aspect of displaying current time-related information as the 'animation (slide bar)' through the display 204. The display 204 illustrated in FIG. 6V may display the current remaining time of the gas cooktop 102 or the oven 104 corresponding to the corresponding knob 108 through the animation of a 'slide bar' shape. That is, FIG. 6V indicates that the remaining time until cooking is completed is approximately 20% of 100% of the entire set time. The set time may be a specific time set by the user, or may be a variable time according to the cooking menu.

FIG. 6VI is an aspect of displaying current temperature-related information as the "number" through the display 204. The display 204 illustrated in FIG. 6VI may display the current set temperature of the gas cooktop 102 or the oven 104 corresponding to the corresponding knob 108 through the number '123° C.'

FIG. 6VII is an aspect of displaying current temperature-related information as the 'animation (slide bar)' through the display 204. The display 204 illustrated in FIG. 6VII displays the current set temperature of the gas cooktop 102 or the oven 104 corresponding to the corresponding knob 108 through the animation of the 'slide bar' shape. That is, FIG. 6VII indicates that the current set temperature is about 40% of the entire temperature range. The entire temperature section may be a specific temperature section set by the user or a temperature section variable according to the cooking menu.

Figure 7:
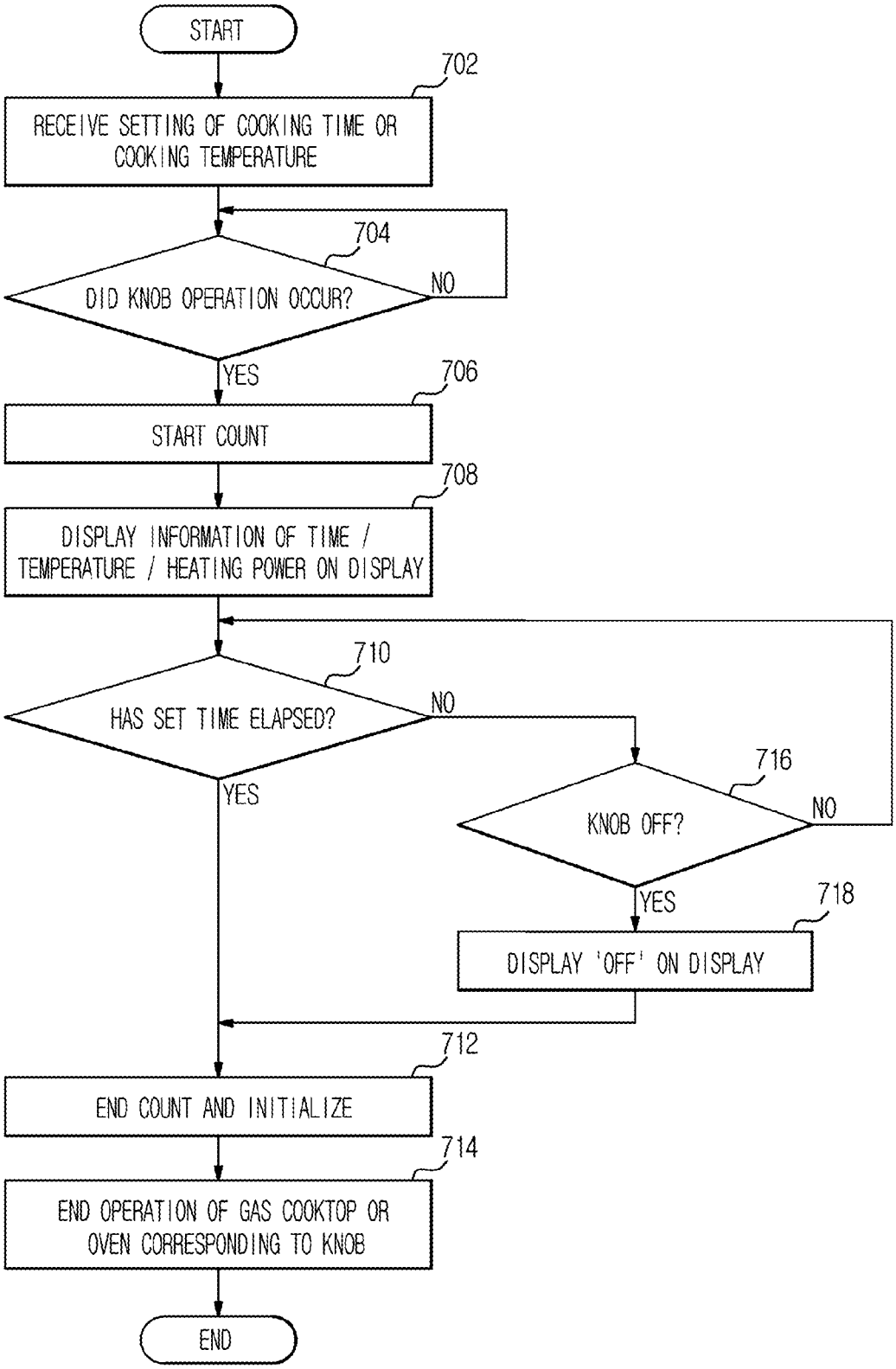
FIG. 7 is a flowchart illustrating a method of controlling a cooking apparatus according to an embodiment.

FIG. 7 is a flowchart illustrating a method of controlling a cooking apparatus according to an embodiment.

The cooking apparatus controller 402 receives the setting of the cooking time or cooking temperature generated through the user interface 106 or the setting device 414 (702).

The cooking apparatus controller 402 may identify whether the operation of the knob 108 occurs while the cooking time or cooking temperature is set (704). The operation of the knob 108 may be that the user turns on the gas cooktop 102 or the oven 104 and operates the knob 108 to set the heating power.

When the operation of the knob 108 occurs while the cooking time is set, the cooking apparatus controller 402 may count the cooking time (706).

In addition, the cooking apparatus controller 402 may display at least one of the current counting time, set temperature, and current heating power information on the displays 204 and 214 of the knob 108 (708). What to display among the information of the counting time, the set temperature, and the current heating power may be determined by the user's selection or may be determined according to a cooking progress based on a preset algorithm.

When the set time has elapsed (YES in 710), the cooking apparatus controller 402 may end the count and initialize the display content of the displays 204 and 214 (712).

Subsequently, the cooking apparatus controller 402 may end the operation of the gas cooktop 102 or the oven 104 corresponding to the corresponding knob 108 (714).

When the set time has not yet elapsed (NO in 710) and the knob 108 is switched to an off state by the user's operation (YES in 716), the cooking apparatus controller 402 may display text such as 'OFF' on the displays 204 and 214 of the knob 108 (718). It is also possible to display the off state of the knob 108 in the form of the icon or graphic instead of the text 'OFF.'

Subsequently, the cooking apparatus controller 402 may end the count and initialize the display contents of the displays 204 and 214 (712).

In addition, the cooking apparatus controller 402 may end the operation of the gas cooktop 102 or the oven 104 corresponding to the corresponding knob 108 (714).

The disclosed embodiments are merely illustrative, and those skilled in the art will appreciate that various modifications, changes, and substitutions may be made without departing from the essential characteristics thereof. Therefore, the exemplary embodiments disclosed above and the accompanying drawings are not intended to limit the technical idea, but to describe the technical spirit, and the scope of the technical idea is not limited by the embodiments and the accompanying drawings. The scope of protection shall be interpreted by the following claims, and all technical ideas within the scope of equivalents shall be interpreted as being included in the scope of rights.

The invention claimed is:

1. A cooking apparatus comprising:

a knob comprising:

a knob housing fixed to a front surface of a main body of the cooking apparatus and configured to form a curved surface, a rotating member rotatably installed on the main body through a hole of the knob housing, and a display disposed at the curved surface of the knob housing and provided on an interior curved surface of the knob housing between the interior curved surface of the knob housing and the rotating member in a manner that a curved display surface of the display is aligned with an exterior curved surface of the knob housing and configured to display status information of the cooking apparatus; and a controller configured to transmit the status information of the cooking apparatus displayed on the display through a wireless communication network to a mobile device.

2. The cooking apparatus according to claim 1, wherein the status information of the cooking apparatus displayed on the display comprises at least one of cooking time information and cooking heating power information.

3. The cooking apparatus according to claim 2, wherein the cooking time information comprises information of a time counted through a timer.

4. The cooking apparatus according to claim 2, wherein, when a cooking time is set through a user interface for setting a time, a timer based on the set cooking time is configured to be displayed through the display.

5. The cooking apparatus according to claim 1, wherein a curvature of the display is configured to coincide with a curvature of the knob housing.

6. The cooking apparatus according to claim 1, wherein the display is made of electronic paper.

7. The cooking apparatus according to claim 1, wherein the status information of the cooking apparatus displayed through the display is at least one of numbers and text.

8. The cooking apparatus according to claim 1, wherein the status information of the cooking apparatus is configured to be displayed on the display in at least one of numbers, text, icons, and animation.

9. The cooking apparatus according to claim 1, wherein at least one communication method among Bluetooth and Wi-Fi is used to transmit the status information of the cooking apparatus to the mobile device.

10. A cooking apparatus comprising:

a plurality of heat sources configured to generate heat by burning fuel; and a plurality of knobs provided to correspond to each of the plurality of heat sources, wherein each of the plurality of knobs comprises:

a knob housing fixed to a front surface of a main body of the cooking apparatus and configured to form a curved surface, a rotating member rotatably installed on the main body through a hole of the knob housing, and a display disposed at the curved surface of the knob housing and provided on an interior curved surface of the knob housing between the interior curved surface of the knob housing and the rotating member in a manner that a curved display surface of the display is aligned with an exterior curved surface of the knob housing, and wherein status information of the plurality of heat sources corresponding to each of the plurality of knobs is configured to be displayed for each display of a corresponding knob.

11. The cooking apparatus according to claim 10, wherein the status information of the plurality of heat sources displayed on the display comprises at least one of cooking time information and cooking heating power information.

12. The cooking apparatus according to claim 11, wherein the cooking time information comprises information of a time counted through a timer.

13. The cooking apparatus according to claim 11, wherein, when a cooking time is set through a user interface for setting a time, a timer based on the set cooking time is configured to be displayed through the display.

14. The cooking apparatus according to claim 10, wherein a curvature of the display is configured to coincide with a curvature of the knob housing.

15. The cooking apparatus according to claim 10, wherein the display is made of electronic paper.

16. The cooking apparatus according to claim 10, wherein the status information of the plurality of heat sources displayed through the display is at least one of numbers and text.

17. The cooking apparatus according to claim 10, wherein the status information of the plurality of heat sources are configured to be displayed on the display in at least one of numbers, text, icons, and animation.

* * * * *